US010975819B2

(12) United States Patent
Masti et al.

(10) Patent No.: US 10,975,819 B2
(45) Date of Patent: Apr. 13, 2021

(54) ARRANGEMENT FOR RETAINING A FUEL INJECTOR TO A FUEL RAIL SOCKET

(71) Applicant: DELPHI TECHNOLOGIES IP LIMITED, St. Michael (BB)

(72) Inventors: Ravish S. Masti, Karnataka (IN); Christopher M. Cass, Arlington Heights, IL (US)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/572,927

(22) Filed: Sep. 17, 2019

(65) Prior Publication Data

US 2021/0079877 A1 Mar. 18, 2021

(51) Int. Cl.
*F02M 61/14* (2006.01)
*F02M 63/02* (2006.01)

(52) U.S. Cl.
CPC ..... *F02M 61/14* (2013.01); *F02M 63/0225* (2013.01); *F02M 2200/8053* (2013.01); *F02M 2200/855* (2013.01); *F02M 2200/856* (2013.01)

(58) Field of Classification Search
CPC ..... F02M 61/14; F02M 63/0225; F02M 2200/8053; F02M 2200/855; F02M 2200/856
USPC ..... 123/470
See application file for complete search history.

(56) References Cited

U.S. PATENT DOCUMENTS 7,252,249 B2 8/2007 Molnar
7,438,055 B1 10/2008 Xu et al.
7,556,022 B1 7/2009 Doherty et al.
7,798,127 B2 9/2010 Notaro et al.
7,856,962 B2 12/2010 Harvey et al.
8,479,710 B2 7/2013 Davis
8,646,434 B2 2/2014 Harvey et al.
8,813,722 B2 8/2014 Harvey et al.
9,567,961 B2 2/2017 Cass et al.
9,797,355 B2 10/2017 Reinhardt et al.
9,915,236 B1 3/2018 Bircann
(Continued)

OTHER PUBLICATIONS

Disclosed Anonymously, Unique Fuel Injector Suspension Design for High Pressure Gasoline Direct Injection, Research Disclosure, published May 2014 in paper journal, published digitally Mar. 31, 2014, Research Disclosure database No. 601008, Research Disclosure, Questel Ireland Ltd, Killeman, Kilmaine, County Mayo,Ireland.

*Primary Examiner* — Mahmoud Gimie
(74) *Attorney, Agent, or Firm* — Joshua M. Haines

(57) ABSTRACT

A fuel injector retention arrangement includes an interior space which extends into a fuel rail socket along an axis. A retention flange of a fuel injector extends radially outward therefrom such that the retention flange is disposed within the interior space. A slot extends radially from the interior space to a fuel rail socket exterior surface and a retention groove extends radially outward from the interior space. A retainer includes a first leg extending through the slot and a second leg extending through the slot, the first leg and the second leg being connected to each other at one end by a retainer base. A lobe of the first leg extends into the retention groove and supports the retention flange and a lobe of the second leg extends into the retention groove and supports the retention flange, thereby retaining the fuel injector to the fuel rail socket.

15 Claims, 10 Drawing Sheets

(56) References Cited

U.S. PATENT DOCUMENTS

| | | | | |
|---|---|---|---|---|
| 10,487,786 | B2 * | 11/2019 | Carli | F02M 61/168 |
| 2006/0137659 | A1 * | 6/2006 | Zdroik | F02M 69/042<br>123/470 |
| 2009/0064972 | A1 | 3/2009 | Abe et al. | |
| 2010/0012093 | A1 | 1/2010 | Pepperine et al. | |
| 2012/0067982 | A1 | 3/2012 | Perry et al. | |
| 2014/0203111 | A1 | 7/2014 | Fischer et al. | |
| 2015/0330347 | A1 * | 11/2015 | Pohlmann | F02M 41/00<br>239/408 |

* cited by examiner

ARRANGEMENT FOR RETAINING A FUEL INJECTOR TO A FUEL RAIL SOCKET

TECHNICAL FIELD OF INVENTION

The present invention relates to fuel injectors for supplying fuel to a fuel consuming device and more particularly to an arrangement for retaining such a fuel injector to a fuel rail socket of a fuel rail.

BACKGROUND OF INVENTION

Modern internal combustion engines typically utilize one or more fuel injectors for metering a precise quantity of fuel to be combusted in respective combustion chambers such that the combustion is initiated, by way of non-limiting example only, with a spark from a spark plug. Combustion of the fuel may be used, for example, to propel a motor vehicle and to generate electricity or drive other accessories in support of operation of the motor vehicle. Fuels in liquid form that are commonly used to power the internal combustion engine include, by way of non-limiting example only, gasoline, ethanol, alcohol, diesel fuel, and the like and blends of two or more thereof. Until more recently, fuel injectors commonly referred to as port fuel injectors were predominantly used. Port fuel injectors inject fuel into a port of an intake manifold where the fuel is mixed with air prior to being drawn into the combustion chamber of the internal combustion through an intake valve of the cylinder head. A typical port fuel injector is show in U.S. Pat. No. 7,252,249 to Molnar. In order to increase fuel economy and reduce undesirable emissions produced by combustion of the fuel, direct injection fuel injectors have been increasing in use. As the name suggests, direct injection fuel injectors inject fuel directly into the combustion chamber. An example of such a direct injection fuel injector is described in Unites States Patent Application Publication No. US 2012/0067982 A1 to Perry et al., the disclosure of which is incorporated herein by reference in its entirety.

In a typical internal combustion engine, a plurality of direct injection fuel injectors such as those disclosed in Perry et al. are attached to a common volume of a fuel rail which contains pressurized fuel. The fuel rail includes a plurality of fuel rail sockets which each receive a portion of a respective fuel injector therein. In use, the pressurized fuel acts on the fuel injectors, thereby trying to push the fuel injectors out of their respective fuel rail sockets. It may be desirable to suspend the fuel injectors from their respective fuel rail sockets in order to minimize contact between the internal combustion engine and the fuel injectors, thereby minimizing noise and heat transfer. U.S. Pat. Nos. 8,646,434; 8,813,722; and U.S. Pat. No. 7,856,962 to Harvey et al.; U.S. Pat. No. 8,479,710 to Davis; U.S. Pat. No. 9,567,961 to Cass et al., and U.S. Pat. No. 7,798,127 to Notaro et al.; United Stated Patent Application Publication Nos. US 2010/0012093 A1 to Pepperine et al. and US 2015/0330347 A1 to Pohlmann et al.; and Research Disclosure Publication No. 601008 teach various arrangements for retaining a fuel injector to a fuel rail socket. However, these various arrangements for retaining the fuel injector to the fuel rail socket may be costly and difficult to implement. Furthermore, some of these arrangements for retaining the fuel injector to the fuel rail socket may not be satisfactory when subjected to fuel pressures which are ever increasing in an attempt to achieve greater efficiency and reduced emissions. Consequently, improvements in retaining the fuel injector to the fuel rail socket are always sought.

What is needed is an arrangement for retaining a fuel injector to a fuel rail socket which minimizes or eliminates one or more of the shortcomings set forth above.

SUMMARY OF THE INVENTION

Briefly described, a fuel injector retention arrangement is provided for retaining a fuel injector to a fuel rail socket of a fuel rail where the fuel injector has a fuel injector upper housing which defines a fuel inlet to the fuel injector, the fuel rail socket has a fuel rail socket body, and the fuel rail has a fuel rail volume which receives pressurized fuel. The fuel injector retention arrangement includes a fuel rail socket interior space defined within the fuel rail socket body such that the fuel rail socket interior space extends into the fuel rail socket body along a fuel rail socket axis from a fuel rail socket end surface, the fuel rail socket interior space being in fluid communication with the fuel rail volume; a fuel injector retention flange extending radially outward from the fuel injector upper housing such that the fuel injector retention flange is disposed within the fuel rail socket interior space and such that the fuel inlet is in fluid communication with the fuel rail socket interior space; a fuel rail socket slot extending radially from the fuel rail socket interior space to a fuel rail socket exterior surface and also extending axially to the fuel rail socket end surface; a fuel rail socket retention groove which extends radially outward from the fuel rail socket interior space; and a retainer which is forked, thereby including 1) a retainer first leg located between the fuel injector retention flange and the fuel rail socket end surface and extending through the fuel rail socket slot and 2) a retainer second leg located between the fuel injector retention flange and the fuel rail socket end surface and extending through the fuel rail socket slot, the retainer first leg and the retainer second leg being connected to each other at one end by a retainer base, the retainer first leg having a first retainer lobe which is convex and which extends part way into the fuel rail socket retention groove and part way into the fuel rail socket interior space, thereby supporting the fuel injector retention flange thereon and retaining the fuel injector to the fuel rail socket and the retainer second leg having a second retainer lobe which is convex and which extends part way into the fuel rail socket retention groove and part way into the fuel rail socket interior space, thereby supporting the fuel injector retention flange thereon and retaining the fuel injector to the fuel rail socket.

Another fuel injector retention arrangement includes a fuel rail socket interior space defined within the fuel rail socket body such that the fuel rail socket interior space extends into the fuel rail socket body along a fuel rail socket axis, the fuel rail socket interior space being in fluid communication with the fuel rail volume; a fuel injector retention flange extending radially outward from the fuel injector upper housing such that the fuel injector retention flange is disposed within the fuel rail socket interior space and such that the fuel inlet is in fluid communication with the fuel rail socket interior space; a fuel rail socket slot extending radially from the fuel rail socket interior space to a fuel rail socket exterior surface; a fuel rail socket retention groove which extends radially outward from the fuel rail socket interior space; and a retainer which is forked, thereby including 1) a retainer first leg located adjacent to the fuel injector retention flange and extending through the fuel rail socket slot and 2) a retainer second leg located adjacent to the fuel injector retention flange and extending through the fuel rail socket slot, the retainer first leg and the retainer second leg being connected to each other at one end by a retainer base, the retainer first leg having a first retainer lobe which is convex and which extends part way into the fuel rail socket retention groove and part way into the fuel rail socket interior space, thereby supporting the fuel injector retention flange thereon and retaining the fuel injector to the fuel rail socket and the retainer second leg having a second retainer lobe which is convex and which extends part way into the fuel rail socket retention groove and part way into the fuel rail socket interior space, thereby supporting the fuel injector retention flange thereon and retaining the fuel injector to the fuel rail socket.

A method of assembling the fuel injector retention arrangements includes positioning the fuel injector retention flange within the fuel rail socket interior space; from an initial form, elastically deforming the retainer first leg and the retainer second leg toward each other; positioning the retainer in the fuel rail socket interior space by translating the retainer along the fuel rail socket axis while the retainer first leg and the retainer second leg are elastically deformed toward each other; and after positioning the retainer in the fuel rail socket interior space, allowing the retainer first leg and the retainer second leg to rebound to the initial form, thereby causing the first retainer lobe to extend into the fuel rail socket retention groove and also causing the second retainer lobe to extend into the fuel rail socket retention groove.

The arrangements and methods described herein are simple and economical to produce and use and provides for convenient assembly along the fuel rail socket axis. Furthermore, the retainer snapping into the fuel rail socket retention groove provides robust retention of the fuel injectors and also provides inherent retention of the retainer, thereby requiring no additional features to prevent unintended removal, translation, or rotation of the retainer. Also furthermore, the fuel injector retention arrangements may allow for the fuel rail sockets to be shortened in the direction of the fuel rail socket axis which is beneficial for packaging.

BRIEF DESCRIPTION OF DRAWINGS

This invention will be further described with reference to the accompanying drawings in which.

DETAILED DESCRIPTION OF INVENTION

Figure 1:
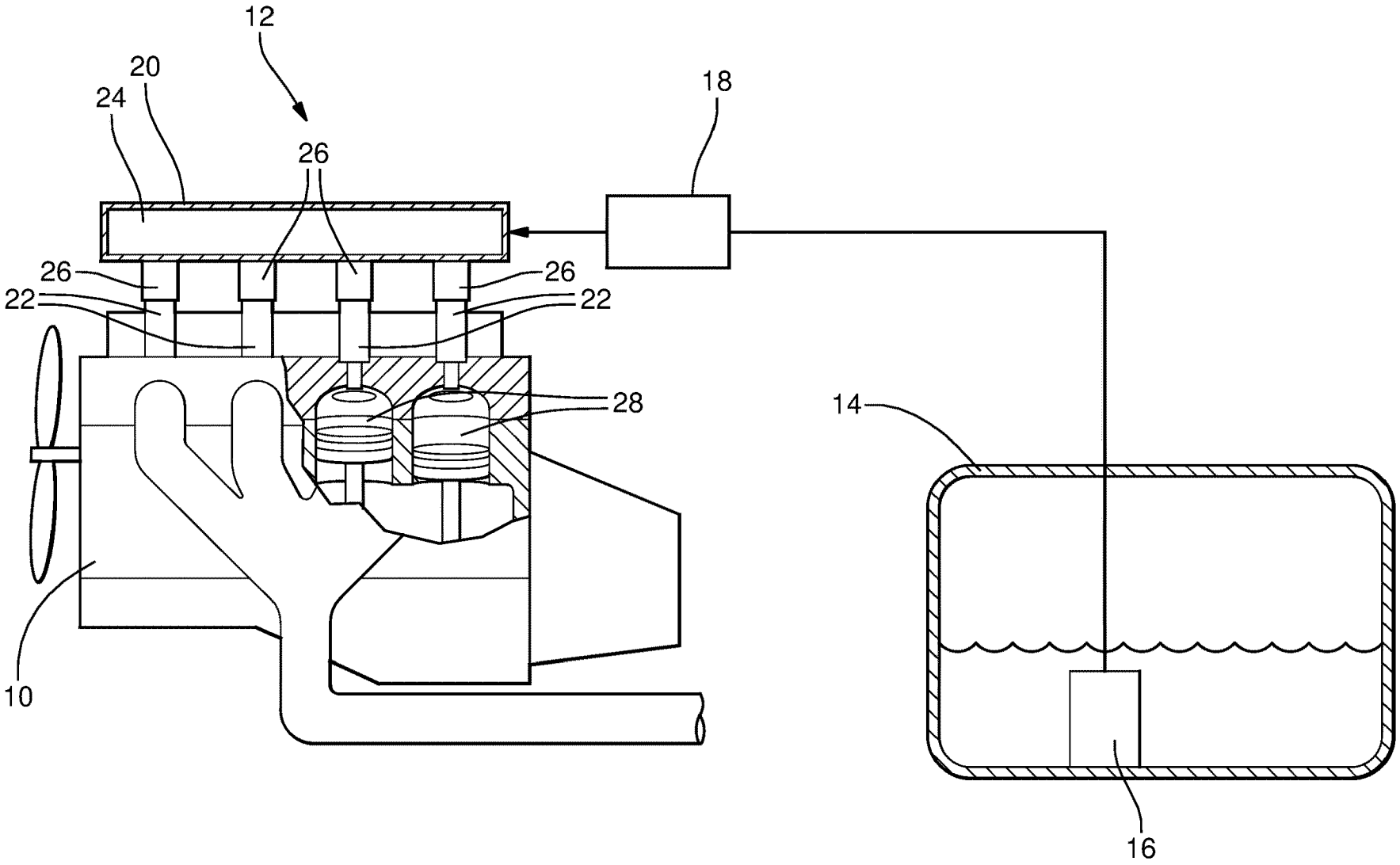
FIG. 1 is a schematic view of an internal combustion engine and a fuel system for the internal combustion engine.
Figure 2:
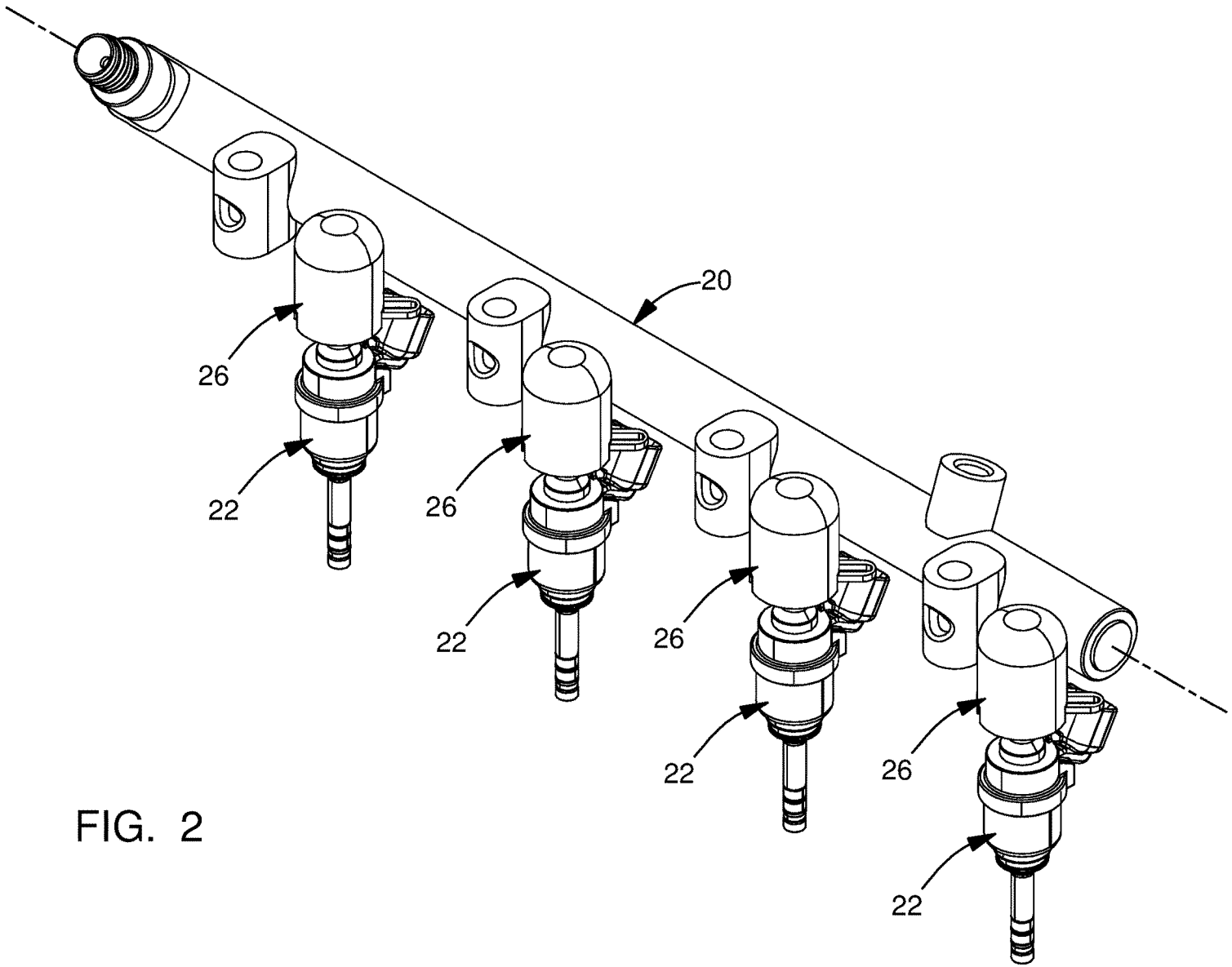
FIG. 2 is an isometric view of a fuel rail and a plurality of fuel injectors of the fuel system of FIG. 2.
Figure 3:
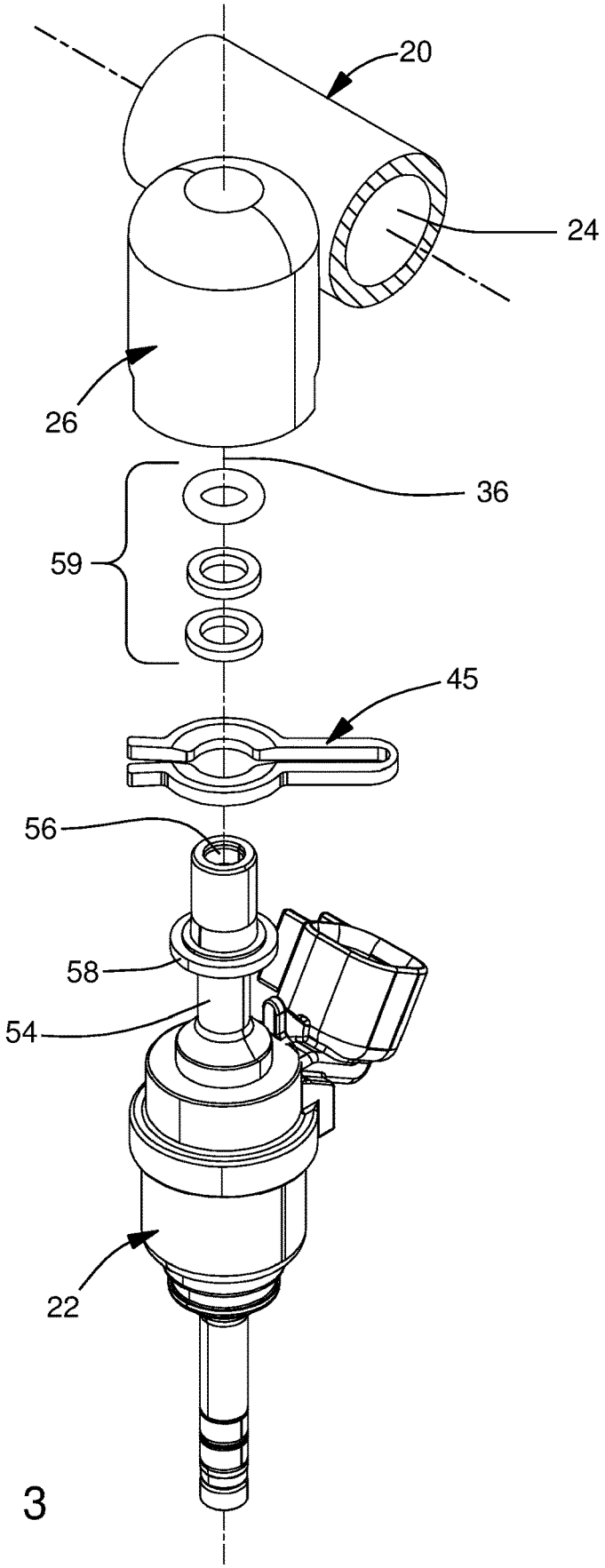
FIG. 3 is an exploded view of one fuel injector and a portion of the fuel rail of FIG. 2.

Reference will first be made to FIG. 1 which shows a fuel consuming device, illustrated as internal combustion engine 10, and a fuel system 12 for supplying fuel to internal combustion engine 10. The fuel supplied to internal combustion engine 10 by fuel system 12 may be, by way of non-limiting example only, gasoline, ethanol, alcohol, diesel fuel, and the like and blends of two or more thereof. As shown herein, fuel system 12 may include a fuel tank 14, a lift pump 16, a high pressure pump 18, a fuel rail 20, and a plurality of fuel injectors 22. Fuel tank 14 stores a volume of fuel which is pumped at relatively low pressure by lift pump 16 to high pressure pump 18. High pressure pump 18 pumps the fuel at a relatively high pressure to a fuel rail volume 24 defined within fuel rail 20. Fuel rail 20 includes a plurality of fuel rail sockets 26 within which a portion of fuel injectors 22 are received and retained. Fuel injectors 22 are each in fluid communication with fuel rail volume 24 through fuel rail sockets 26 in order to receive the pressurized fuel. Each fuel injector 22 is configured to selectively supply fuel to a respective combustion chamber 28 (only two combustion chambers 28 are visible in FIG. 1) where the fuel is combusted in known fashion. Fuel injectors 22 may take numerous forms, but may be a fuel injector as describe in Unites States Patent Application Publication No. US 2012/0067982 A1 to Perry et al., the disclosure of which is incorporated herein by reference in its entirety. While fuel system 12 has been described herein as a fuel system in which fuel is injected directly into combustion chambers 28, it should now be understood that fuel system 12 could alternatively be a fuel system in which the fuel is not injected directly into combustion chambers 28, which may be, by way of non-limiting example only, a port fuel injection system where the fuel injectors inject the fuel into an intake manifold where the fuel and air are introduced into each combustion chamber together through a respective intake combustion valve. In a port fuel injection system, high pressure pump 18 may be omitted and fuel is delivered directly to the fuel rail volume 24 by lift pump 16.

With continued reference to FIG. 1 and now with additional reference to FIGS. 2-10, a fuel injector retention arrangement 30 in accordance with a preferred embodiment of this invention will be described. Each fuel injector 22 may be retained to its respective fuel rail socket 26 in the same way; and consequently, the description that follows will refer to one fuel rail socket 26 and one fuel injector 22 with the understanding that the description is equally applicable to each pair of fuel rail sockets 26 and fuel injectors 22.

Fuel rail socket 26 has a fuel rail socket body 32 with a fuel rail socket interior space 34 defined therein. Fuel rail socket interior space 34 extends into fuel rail socket body 32 along a fuel rail socket axis 36 from a fuel rail socket end surface 37 of a fuel rail socket open end 38 to a fuel rail socket closed end 40 such that fuel rail socket interior space 34 is stepped, thereby defining a fuel rail socket shoulder 42 therein which faces toward fuel rail socket open end 38. Fuel rail socket 26 is fixed to fuel rail 20, by way of non-limiting example only, by welding or brazing or by being formed integrally therewith as a single piece of material. Fluid communication between fuel rail volume 24 and fuel rail socket interior space 34 is provided by a fuel passage 44 which extends from fuel rail volume 24 to fuel rail socket interior space 34 through fuel rail 20 and fuel rail socket body 32.

Features of fuel rail socket 26 which interact with a retainer 45 which retains fuel injector 22 to fuel rail socket 26 will now be described. A first fuel rail socket slot 46 extends radially from fuel rail socket interior space 34 to a fuel rail socket exterior surface 48 of fuel rail socket 26 where fuel rail socket exterior surface 48 extends around the entire periphery of fuel rail socket 26. First fuel rail socket slot 46 also extends axially, i.e. parallel to fuel rail socket axis 36, to fuel rail socket end surface 37. By way of non-limiting example only, first fuel rail socket slot 46 may extend about 25° to about 35° around fuel rail socket end surface 37. A second fuel rail socket slot 50 extends radially from fuel rail socket interior space 34 to fuel rail socket exterior surface 48 such that second fuel rail socket slot 50 is diametrically opposed to first fuel rail socket slot 46. Second fuel rail socket slot 50 also extends axially, i.e. parallel to fuel rail socket axis 36, to fuel rail socket end surface 37. By way of non-limiting example only, second fuel rail socket slot 50 may extend about 25° to about 35° around fuel rail socket end surface 37.

In addition to first fuel rail socket slot 46 and second fuel rail socket slot 50 which interface with retainer 45, fuel rail socket 26 also includes a fuel rail socket retention groove 52 which extends radially outward from fuel rail socket interior space 34 toward fuel rail socket exterior surface 48, but does not extend all the way to fuel rail socket exterior surface 48, i.e. fuel rail socket retention groove 52 extends radially outward from fuel rail socket interior space 34 only part way into fuel rail socket body 32 except at first fuel rail socket slot 46 and second fuel rail socket slot 50 as will be described in greater detail later. Fuel rail socket retention groove 52 extends axially, i.e. in a direction parallel to fuel rail socket axis 36 from a fuel rail socket retention groove upper surface 52*a* to a fuel rail socket retention groove lower surface 52*b* such that fuel rail socket retention groove upper surface 52*a* and fuel rail socket retention groove lower surface 52*b* are each traverse to fuel rail socket axis 36 and may be perpendicular to fuel rail socket axis 36 as shown in the figures. Fuel rail socket retention groove 52 extends radially outward to a fuel rail socket retention groove radially outer surface 52*c* which joins fuel rail socket retention groove upper surface 52*a* to fuel rail socket retention groove lower surface 52*b* and may be parallel to fuel rail socket axis 36 as shown in the figures. As illustrated herein, fuel rail socket retention groove 52 includes a fuel rail socket retention groove first portion 52*d* located between first fuel rail socket slot 46 and second fuel rail socket slot 50 and also includes a fuel rail socket retention groove second portion 52*e* located between first fuel rail socket slot 46 and second fuel rail socket slot 50 such that first fuel rail socket slot 46 and second fuel rail socket slot 50 separate fuel rail socket retention groove first portion 52*d* from fuel rail socket retention groove second portion 52*e*. Also as illustrated herein, fuel rail socket retention groove first portion 52*d* may extend from where first fuel rail socket slot 46 meets fuel rail socket exterior surface 48 to where second fuel rail socket slot 50 meets fuel rail socket exterior surface 48 and fuel rail socket retention groove second portion 52*e* may extend from where first fuel rail socket slot 46 meets fuel rail socket exterior surface 48 to where second fuel rail socket slot 50 meets fuel rail socket exterior surface 48. Alternatively, but not shown, fuel rail socket retention groove first portion 52*d* may extend only from where first fuel rail socket slot 46 meets fuel rail socket interior space 34 to where second fuel rail socket slot 50 meets fuel rail socket interior space 34 and fuel rail socket retention groove second portion 52*e* may extend only from where first fuel rail socket slot 46 meets fuel rail socket interior space 34 to where second fuel rail socket slot 50 meets fuel rail socket interior space 34.

Fuel injector 22 includes a fuel injector upper housing 54 which is received coaxially within fuel rail socket interior space 34 and which defines a fuel inlet 56 to fuel injector 22 which receives fuel from fuel rail socket interior space 34. Fuel injector upper housing 54 includes a fuel injector retention flange 58 which extends radially outward therefrom and which is disposed within fuel rail socket interior space 34 such that fuel inlet 56 is in fluid communication with fuel rail socket interior space 34. Fuel injector retention flange 58 is annular in shape and includes a fuel injector retention flange upper surface 58*a* which faces toward fuel rail socket closed end 40 and also includes a fuel injector retention flange lower surface 58*b* which faces toward fuel rail socket open end 38. A sealing arrangement 59, which may include an O-ring and one or more backup rings as illustrated in the figures, is supported by fuel injector retention flange upper surface 58*a* thereby providing a fuel-tight seal between fuel injector upper housing 54 and fuel rail socket 26 in order to prevent fuel from escaping to the environment from fuel rail socket interior space 34. Fuel injector retention flange lower surface 58*b* may be spherical or conical in shape as illustrated in the figures in order to accommodate angular misalignment between fuel injector 22 and fuel rail socket axis 36, as will be described in greater detail later, such that fuel injector retention flange lower surface 58*b* engages retainer 45, also as will be described in greater detail later. As used herein, the term spherical is intended to include a portion of the surface of a sphere and conical is intended to include a portion of the lateral surface of a cone.

Retainer 45 is forked, thereby including a retainer first leg 60 and a retainer second leg 62 such that one end of retainer first leg 60 and one end of retainer second leg 62 are connected to each other by a retainer base 64 where retainer first leg 60, retainer second leg 62, and retainer base 64 are preferably made of a single, unitary piece of material which may preferably be metal such as steel. Retainer first leg 60 and retainer second leg 62 are each located axially between fuel injector retention flange 58 and fuel rail socket end surface 37 and each extend through first fuel rail socket slot 46 and through second fuel rail socket slot 50. In order to secure retainer 45 to fuel rail socket 26, retainer first leg 60 includes a first retainer lobe 60*a* which is convex facing toward fuel rail socket retention groove radially outer surface 52*c* of fuel rail socket retention groove first portion 52*d* and which extends part way into fuel rail socket retention groove first portion 52*d* and part way into fuel rail socket interior space 34. Similarly, retainer second leg 62 includes a second retainer lobe 62*a* which is convex is convex facing toward fuel rail socket retention groove radially outer surface 52*c* of fuel rail socket retention groove second portion 52*e* and which extends part way into fuel rail socket retention groove second portion 52*e* and part way into fuel rail socket interior space 34. The portions of first retainer lobe 60*a* and second retainer lobe 62*a* which extend into fuel rail socket interior space 34 engage fuel injector retention flange lower surface 58*b* and thereby support fuel injector retention flange 58 thereon and retain fuel injector 22 to fuel rail socket 26.

Figure 6:
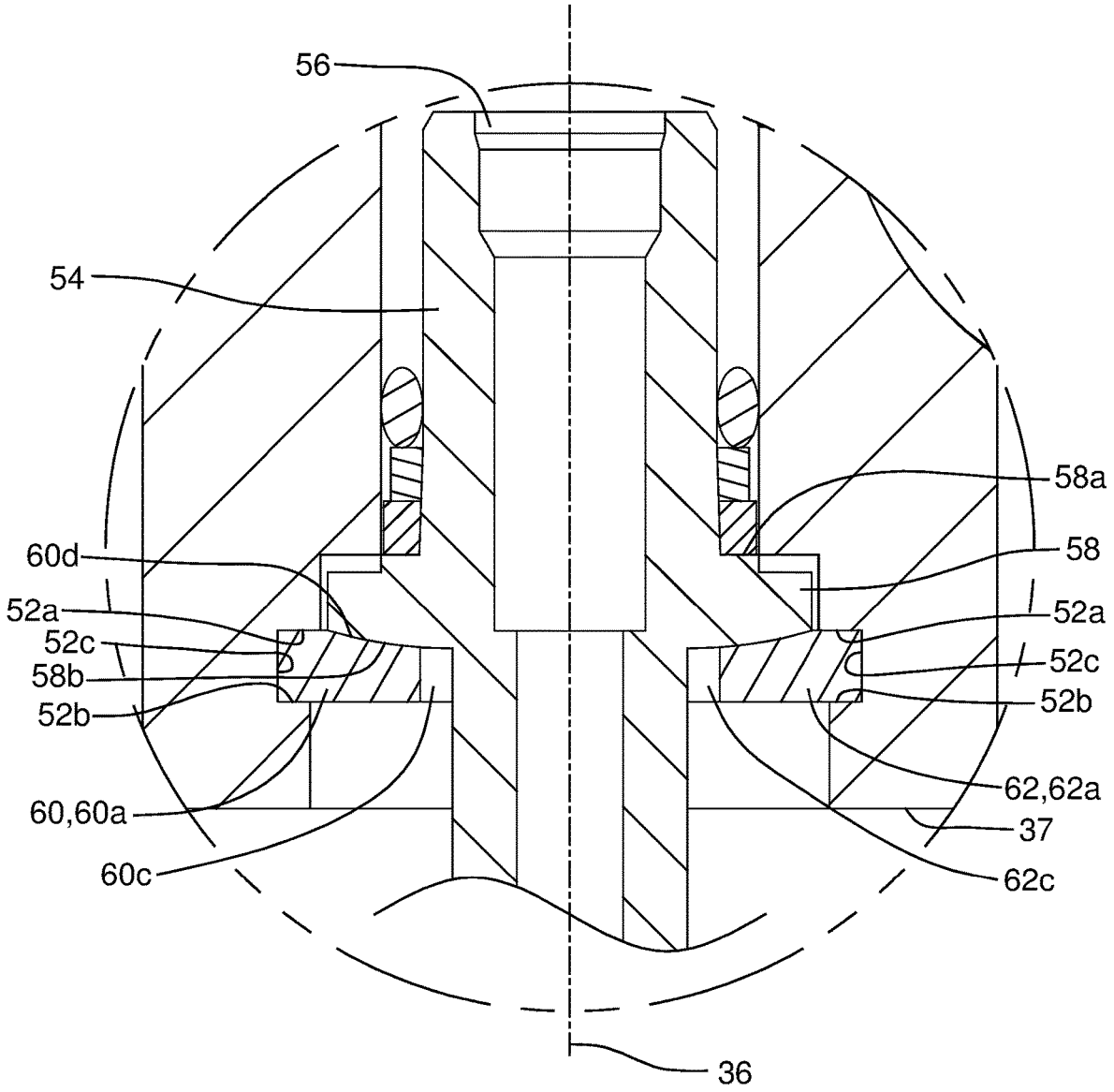
FIG. 6 is an enlargement of a portion of FIG. 5.
Figure 7:
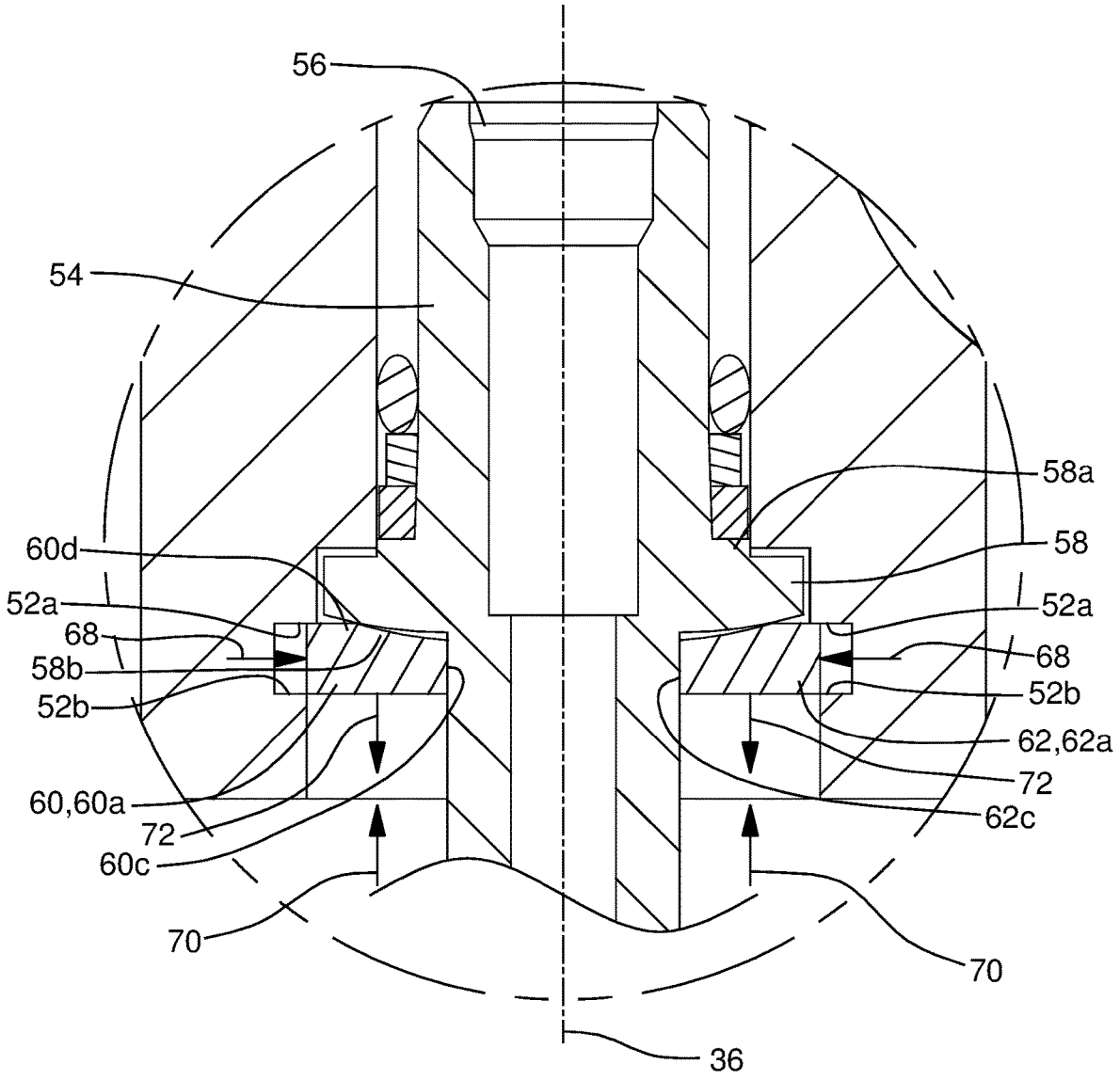
FIG. 7 is the view of FIG. 6, now showing the retainer in a position which allows for insertion and removal of the retainer.
Figure 8:
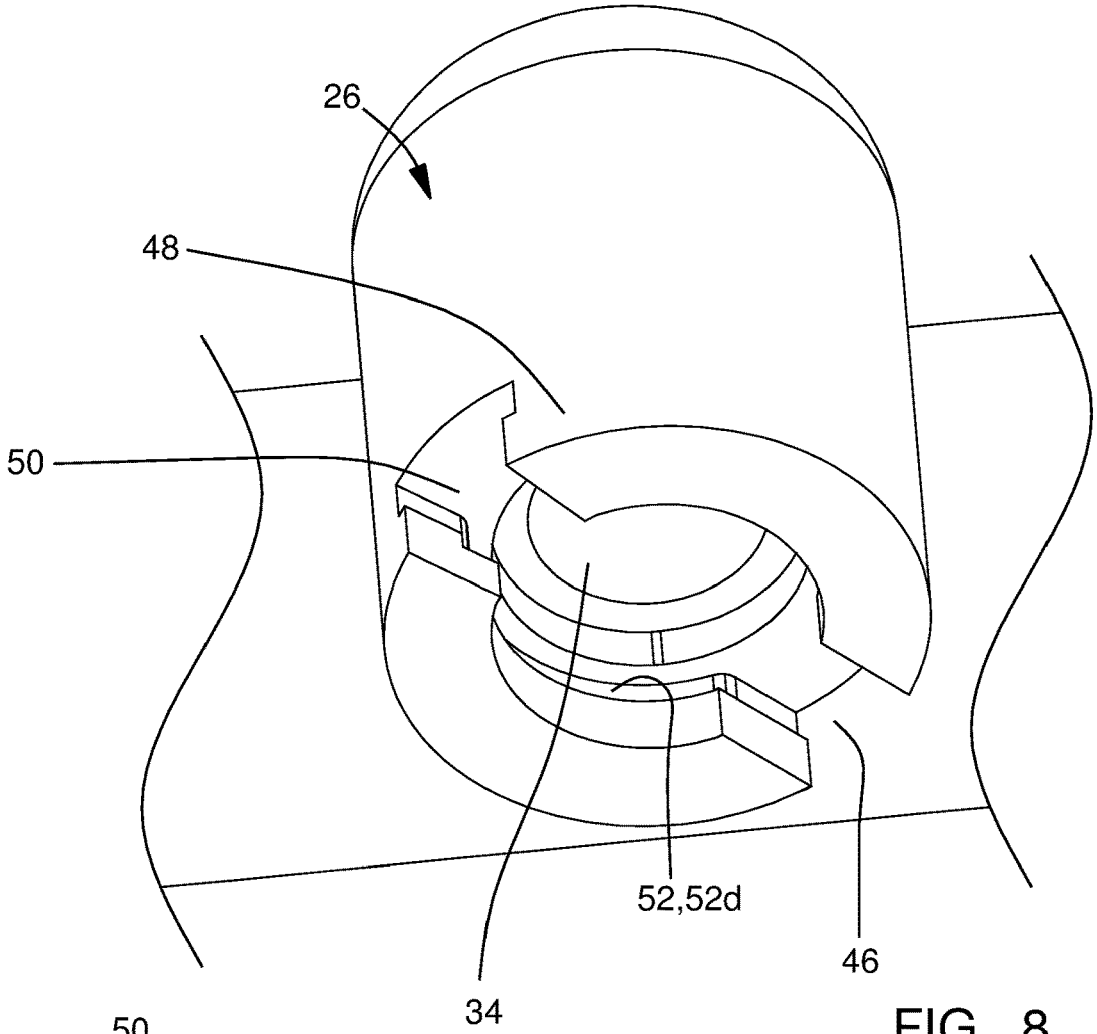
FIGS. 8 and 9 are isometric views of the fuel rail socket shown without the fuel injector or the retainer installed.
Figure 9:
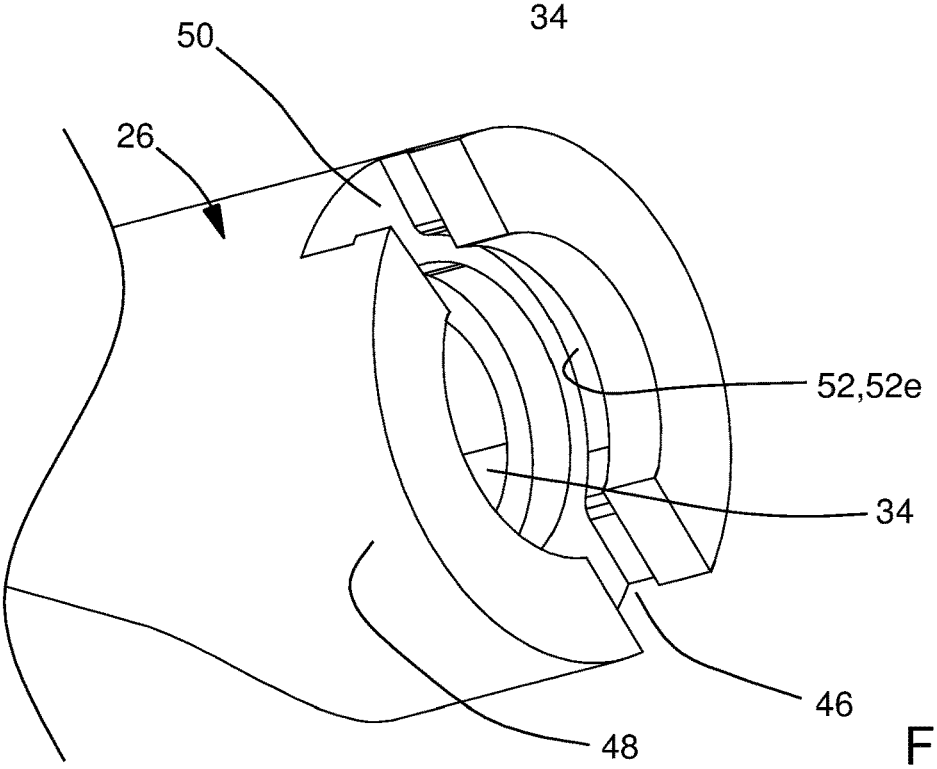
Figure 10:
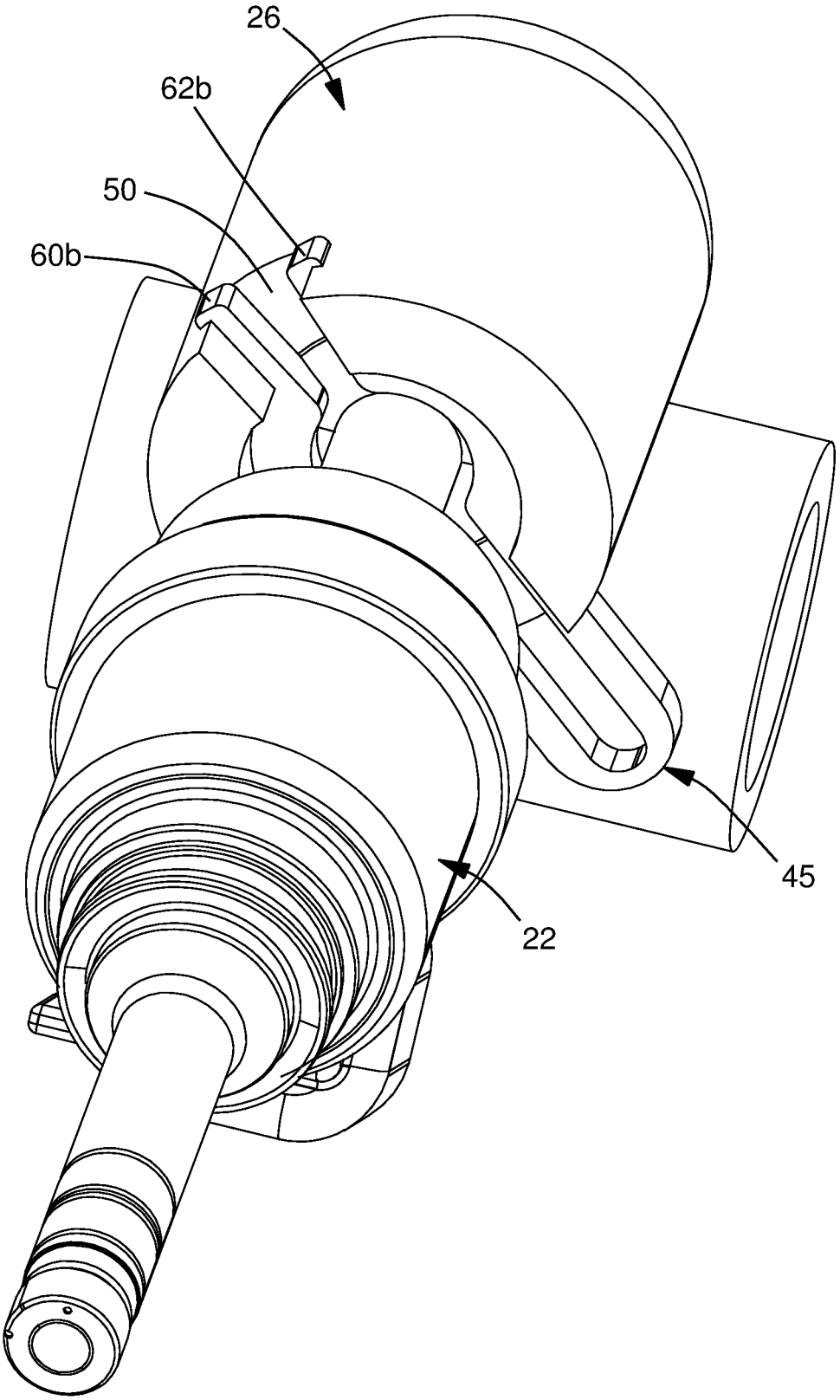
FIG. 10 is an isometric view of the fuel injector and the retainer installed within the fuel injector socket.
Figure 11:
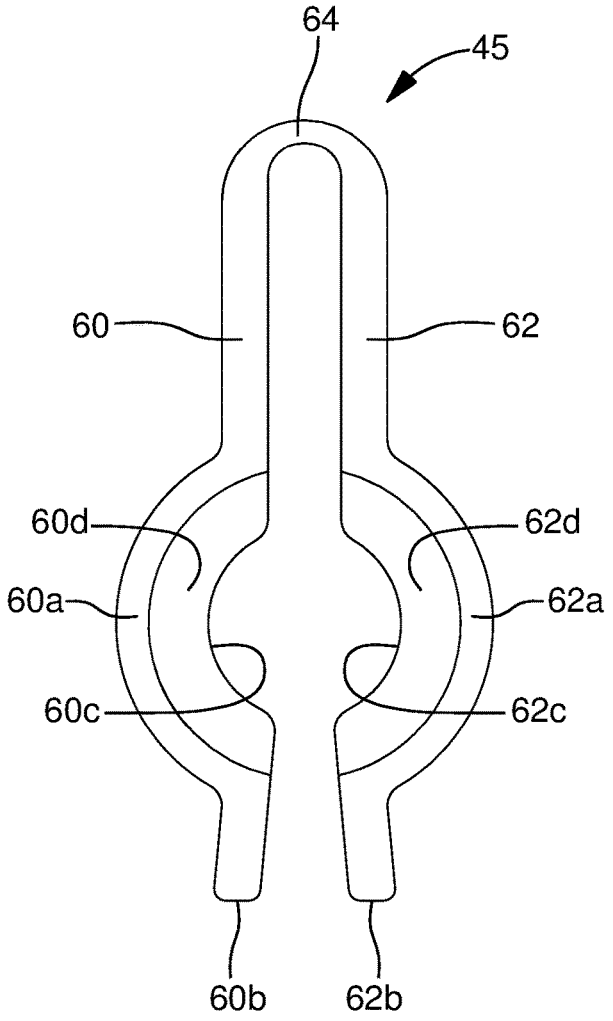
FIG. 11 is a face-on view of the retainer.
Figure 12:
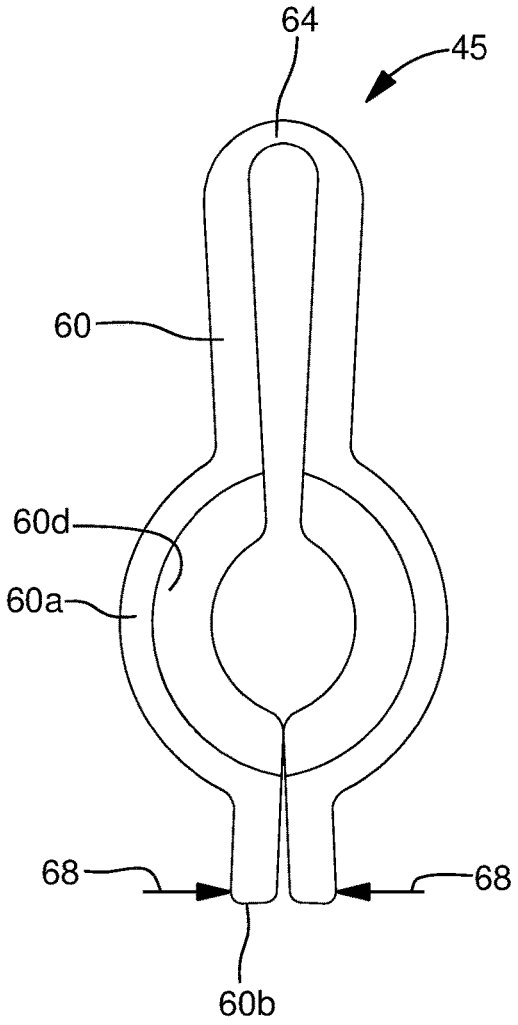
FIG. 12 is the view of FIG. 11, now showing the retainer elastically deformed which allows for insertion and removal of the retainer.

Retainer first leg 60 terminates at a retainer first leg free end 60*b* which is distal from retainer base 64, and similarly, retainer second leg 62 terminates at a retainer second leg free end 62*b* which is distal from retainer base 64. Retainer first leg free end 60*b* and retainer second leg free end 62*b* are separated from each other as illustrated in FIG. 11 when both first retainer lobe 60*a* and second retainer lobe 62*a* are within fuel rail socket retention groove first portion 52*d* as illustrated in FIG. 6 and fuel rail socket retention groove second portion 52*e* respectively. Retainer 45 is elastically deformable which allows retainer first leg free end 60*b* and retainer second leg free end 62*b* to be elastically moved toward each other as illustrated in FIG. 12 which causes 1) first retainer lobe 60*a* to be completely removed from fuel rail socket retention groove first portion 52*d* and 2) second retainer lobe 62*a* to be completely removed from fuel rail socket retention groove second portion 52*e* as illustrated in FIG. 7, thereby allowing retainer 45 to be installed and removed within fuel rail socket interior space 34 in a direction along fuel rail socket axis 36. In order to provide clearance for fuel injector upper housing 54 when retainer first leg free end 60*b* and retainer second leg free end 62*b* are elastically moved toward each, retainer first leg 60 includes a first retainer recess 60*c* which is concave facing toward retainer second leg 62 and which is radially aligned with fuel injector upper housing 54, and similarly, retainer second leg 62 includes a second retainer recess 62*c* which is concave facing toward retainer first leg 60 and which is radially aligned with fuel injector upper housing 54. Consequently, when retainer first leg free end 60*b* and retainer second leg free end 62*b* are elastically moved toward each other in order to allow said retainer 45 to be installed within, or removed from, fuel rail socket interior space 34 along fuel rail socket axis 36, fuel injector upper housing 54 is accommodated, i.e. located within, first retainer recess 60*c* and second retainer recess 62*c*.

The portion of retainer first leg 60 which is between retainer base 64 and first retainer lobe 60*a* extends part way into fuel rail socket retention groove first portion 52*d* and part way into first fuel rail socket slot 46 and the portion of retainer first leg 60 which is between first retainer lobe 60*a* and retainer first leg free end 60*b* extends part way into fuel rail socket retention groove first portion 52*d* and part way into second fuel rail socket slot 50. Similarly, the portion of retainer second leg 62 which is between retainer base 64 and second retainer lobe 62*a* extends part way into fuel rail socket retention groove second portion 52*e* and part way into first fuel rail socket slot 46 and the portion of retainer second leg 62 which is between second retainer lobe 62*a* and retainer second leg free end 62*b* extends part way into fuel rail socket retention groove second portion 52*e* and part way into second fuel rail socket slot 50. It should be noted that if fuel rail socket retention groove first portion 52*d* extends only from where first fuel rail socket slot 46 meets fuel rail socket interior space 34 to where second fuel rail socket slot 50 meets fuel rail socket interior space 34 and fuel rail socket retention groove second portion 52*e* extends only from where first fuel rail socket slot 46 meets fuel rail socket interior space 34 to where second fuel rail socket slot 50 meets fuel rail socket interior space 34, then only first retainer lobe 60*a* and second retainer lobe 62*a* extend into fuel rail socket retention groove 52.

In order to accommodate angular misalignment between fuel injector 22 and fuel rail socket axis 36 while allowing fuel injector retention flange lower surface 58*b* to maintain contact with both retainer first leg 60 and retainer second leg 62, retainer first leg 60 has a retainer first leg surface 60*d* which is spherical or conical and which engages fuel injector retention flange lower surface 58*b*, thereby supporting fuel injector retention flange 58. Retainer first leg surface 60*d* is located radially outward from first retainer recess 60*c* relative to fuel rail socket axis 36. Similarly, retainer second leg 62 has a retainer second leg surface 62*d* which is spherical or conical and which engages fuel injector retention flange lower surface 58*b*, thereby supporting fuel injector retention flange 58. It should be noted that if fuel injector retention flange lower surface 58*b* is conical, then retainer first leg surface 60*d* a retainer second leg surface 62*d* are each spherical and if retainer first leg surface 60*d* and retainer second leg surface 62*d* are each conical, then fuel injector retention flange lower surface 58*b* is spherical. However, if fuel injector retention flange lower surface 58*b* is spherical, retainer first leg surface 60*d* and retainer second leg surface 62*d* may also be spherical. In this way, fuel injector 22 can be angularly misaligned with fuel rail socket axis 36 while maintaining contact of fuel injector retention flange lower surface 58*b* with both retainer first leg 60 and retainer second leg 62. Retainer second leg surface 62*d* is located radially outward from second retainer recess 62*c* relative to fuel rail socket axis 36.

Figure 4:
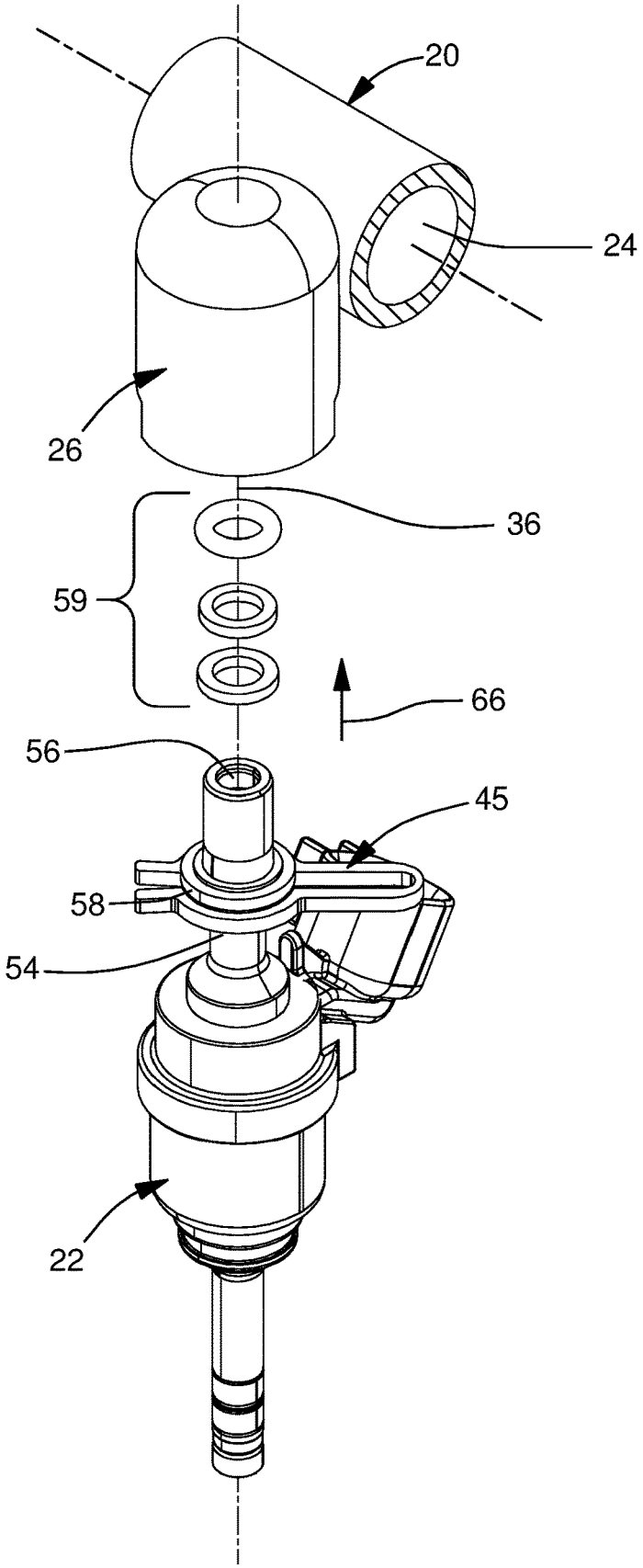
FIG. 4 is the view of FIG. 3, now shown with a retainer positioned on the fuel injector.
Figure 5:
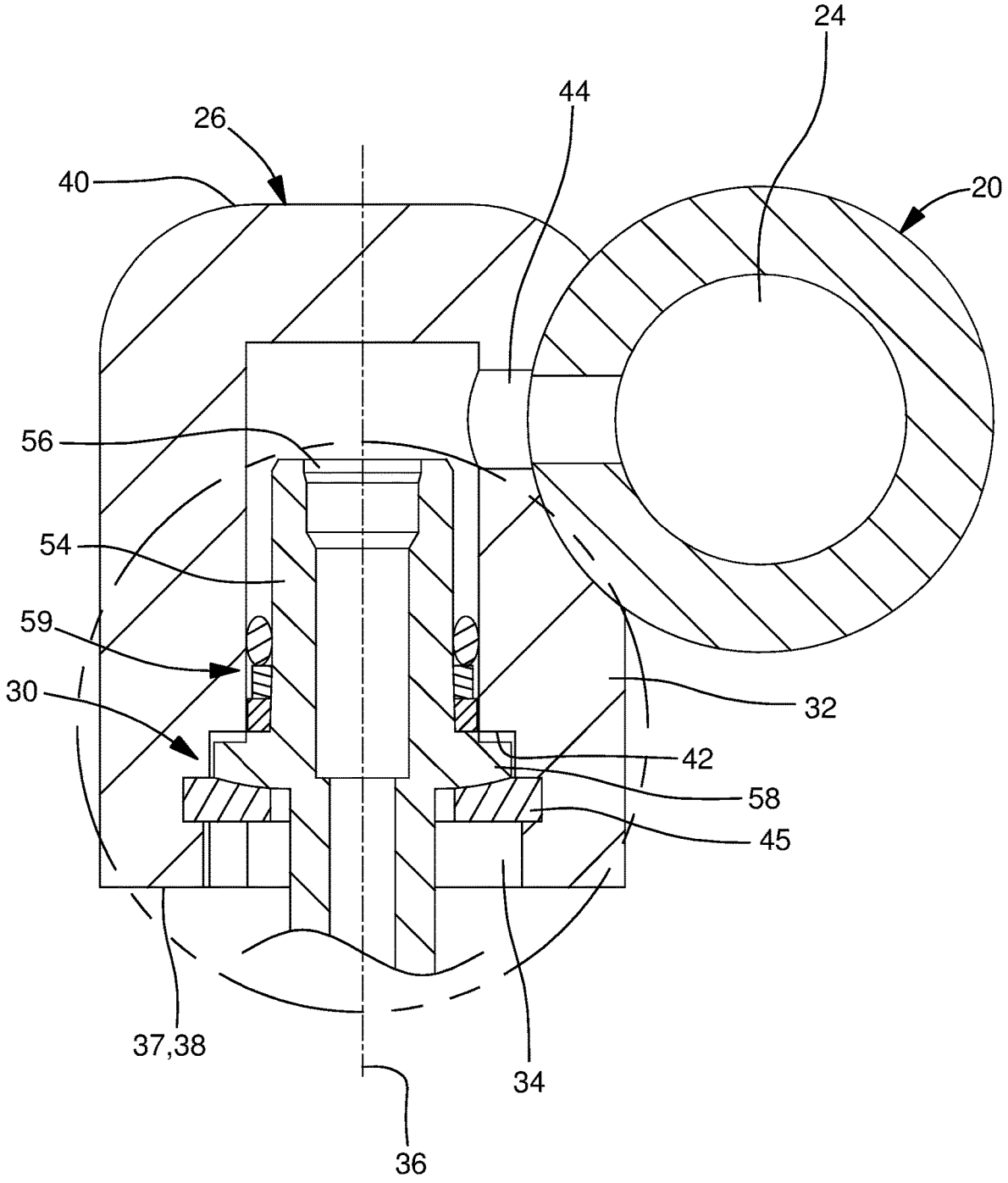
FIG. 5 is a cross-sectional view showing a fuel injector retention arrangement which retains the fuel injector in a fuel rail socket of the fuel rail.

In order to assemble fuel injector 22 to fuel rail socket 26, fuel injector upper housing 54 is inserted into fuel rail socket interior space 34 by translation along fuel rail socket axis 36 as indicated by arrow 66 in FIG. 4. It should be noted that retainer 45 may be placed around fuel injector upper housing 54 as shown in FIG. 4 prior to fuel injector upper housing 54 being inserted into fuel rail socket interior space 34 or may alternatively be placed around injector housing after fuel injector upper housing 54 is inserted into fuel rail socket interior space 34. After fuel injector upper housing 54 is inserted into fuel rail socket interior space 34 and after retainer 45 is placed around fuel injector upper housing 54, retainer 45, from an initial form as illustrated in FIG. 11, is elastically deformed as illustrated in FIGS. 7 and 12 by application of force on retainer first leg 60 and retainer second leg 62 in the direction of arrows 68. Next, retainer 45 is translated along fuel rail socket axis 36 as indicated by arrows 70 in FIG. 7 and when first retainer lobe 60*a* and second retainer lobe 62*a* are aligned with fuel rail socket retention groove first portion 52*d* and fuel rail socket retention groove second portion 52*e* respectively, the force which elastically deformed retainer 45 is removed, thereby allowing retainer 45 to snap back to its original shape, thereby causing first retainer lobe 60*a* and second retainer lobe 62*a* to snap into fuel rail socket retention groove first portion 52*d* and fuel rail socket retention groove second portion 52*e* respectively. Disassembly is simply a reverse of the assembly process. Namely, retainer 45 is elastically deformed as illustrated in FIGS. 7 and 12 by application of force in the direction of arrows 68, thereby causing first retainer lobe 60*a* and second retainer lobe 62*a* to be completely removed from fuel rail socket retention groove first portion 52*d* and fuel rail socket retention groove second portion 52*e*. Next, retainer 45 is translated along fuel rail socket axis 36 as indicated by arrows 72. After retainer 45 is removed from fuel rail socket interior space 34, the force used to elastically deform retainer 45 can be removed, thereby allowing retainer 45 to rebound to its initial form. Now, fuel injector upper housing 54 can be removed from fuel rail socket interior space 34 be translation along fuel rail socket axis 36 in the direction opposite arrow 66 in FIG. 4.

Fuel injector retention arrangement 30 as described, utilizes retainer 45 which is a one-piece element which is simple and economical to produce and provides for convenient assembly along fuel rail socket axis 36. Furthermore, retainer 45 snapping into fuel rail socket retention groove first portion 52*d* and fuel rail socket retention groove second portion 52*e* provides robust retention of fuel injectors 22 and also provides inherent retention of retainer 45, thereby requiring no additional features to prevent unintended removal, translation, or rotation of retainer 45. Also furthermore, fuel injector retention arrangement 30 may allow for fuel rail sockets 26 to be shortened in the direction of fuel rail socket axis 36 which is beneficial for packaging.

While this invention has been described in terms of the preferred embodiments thereof, it is not intended to be so limited, but rather only to the extent set forth in the claims that follow.

We claim:

1. A fuel injector retention arrangement for retaining a fuel injector to a fuel rail socket of a fuel rail, said fuel injector having a fuel injector upper housing which defines a fuel inlet to said fuel injector, said fuel rail socket having a fuel rail socket body, and said fuel rail having a fuel rail volume which receives pressurized fuel; said fuel injector retention arrangement comprising:

a fuel rail socket interior space defined within said fuel rail socket body such that said fuel rail socket interior space extends into said fuel rail socket body along a fuel rail socket axis from a fuel rail socket end surface, said fuel rail socket interior space being in fluid communication with said fuel rail volume;

a fuel injector retention flange extending radially outward from said fuel injector upper housing such that said fuel injector retention flange is disposed within said fuel rail socket interior space and such that said fuel inlet is in fluid communication with said fuel rail socket interior space;

a fuel rail socket slot extending radially from said fuel rail socket interior space to a fuel rail socket exterior surface and also extending axially to said fuel rail socket end surface;

a fuel rail socket retention groove which extends radially outward from said fuel rail socket interior space; and a retainer which is forked, thereby including 1) a retainer first leg located between said fuel injector retention flange and said fuel rail socket end surface and extending through said fuel rail socket slot and 2) a retainer second leg located between said fuel injector retention flange and said fuel rail socket end surface and extending through said fuel rail socket slot, said retainer first leg and said retainer second leg being connected to each other at one end by a retainer base, said retainer first leg having a first retainer lobe which is convex and which extends part way into said fuel rail socket retention groove and part way into said fuel rail socket interior space, thereby supporting said fuel injector retention flange thereon and retaining said fuel injector to said fuel rail socket and said retainer second leg having a second retainer lobe which is convex and which extends part way into said fuel rail socket retention groove and part way into said fuel rail socket interior space, thereby supporting said fuel injector retention flange thereon and retaining said fuel injector to said fuel rail socket;

wherein:

said fuel injector retention flange includes a fuel injector retention flange surface which is spherical or conical;

said retainer first leg has a retainer first leg surface which is spherical or conical and which supports said fuel injector retention flange; and said retainer second leg has a retainer second leg surface which is spherical or conical and which supports said fuel injector retention flange;

whereby said fuel injector retention flange surface, said retainer first leg surface, and said retainer second leg surface allow angular misalignment between said fuel injector upper housing and said fuel rail socket.

2. A fuel injector retention arrangement as in claim 1, wherein said fuel rail socket slot is a first fuel rail socket slot and said fuel injector retention arrangement further comprises a second fuel rail socket slot extending radially from said fuel rail socket interior space to said fuel rail socket exterior surface and also extending axially to said fuel rail socket end surface such that said second fuel rail socket slot is diametrically opposed to said first fuel rail socket slot, wherein said retainer first leg and said retainer second leg each extend through said second fuel rail socket slot.

3. A fuel injector retention arrangement as in claim 2, wherein said fuel rail socket retention groove includes a fuel rail socket retention groove first portion located between said first fuel rail socket slot and said second fuel rail socket slot and a fuel rail socket retention groove second portion located between said first fuel rail socket slot and said second fuel rail socket slot such that said first fuel rail socket slot and said second fuel rail socket slot separate said fuel rail socket retention groove first portion from said fuel rail socket retention groove second portion.

4. A fuel injector retention arrangement as in claim 2, wherein:

said retainer first leg has a retainer first leg free end which is distal from said retainer base;

said retainer second leg has a retainer second leg free end which is distal from said retainer base and which is separated from said retainer first leg free end when both said first retainer lobe is in said fuel rail socket retention groove and said second retainer lobe is in said fuel rail socket retention grove; and said retainer is elastically deformable which allows said retainer first leg free end and said retainer second leg free end to be elastically moved toward each other which causes 1) said first retainer lobe to be completely removed from said fuel rail socket retention groove and 2) said second retainer lobe to be completely removed from said fuel rail socket retention groove, thereby allowing said retainer to be installed into, and removed, from within said fuel rail socket interior space in a direction along said fuel rail socket axis.

5. A fuel injector retention arrangement as in claim 4, wherein:

said retainer first leg includes a first retainer recess which is concave facing toward said retainer second leg, said first retainer recess accommodating said fuel injector upper housing when said retainer first leg free end and said retainer second leg free end are elastically moved toward each other in order to allow said retainer to be installed into, and removed, from within said fuel rail socket interior space in a direction along said fuel rail socket axis; and said retainer second leg includes a second retainer recess which is concave facing toward said retainer first leg, said second retainer recess accommodating said fuel injector upper housing when said retainer first leg free end and said retainer second leg free end are elastically moved toward each other in order to allow said retainer to be installed into, and removed from, within said fuel rail socket interior space in a direction along said fuel rail socket axis.

6. A fuel injector retention arrangement as in claim 4, wherein:

a portion of said retainer first leg which is between said retainer base and said first retainer lobe is located within said fuel rail socket retention groove;

a portion of said retainer first leg which is between said first retainer lobe and said retainer first leg free end is located within said fuel rail socket retention groove;

a portion of said retainer second leg which is between said retainer base and said second retainer lobe is located within said fuel rail socket retention groove; and a portion of said retainer second leg which is between said second retainer lobe and said retainer second leg free end is located within said fuel rail socket retention groove.

7. A fuel injector retention arrangement as in claim 1, wherein:

said retainer first leg has a retainer first leg free end which is distal from said retainer base;

said retainer second leg has a retainer second leg free end which is distal from said retainer base and which is separated from said retainer first leg free end when both said first retainer lobe is in said fuel rail socket slot and said second retainer lobe is in said fuel rail socket slot; and said retainer is elastically deformable which allows said retainer first leg free end and said retainer second leg free end to be elastically moved toward each other which causes 1) said first retainer lobe to be completely removed from said fuel rail socket slot and said second retainer lobe to be completely removed form said fuel rail socket slot, thereby allowing said retainer to be installed into, and removed, from within said fuel rail socket interior space in a direction along said fuel rail socket axis.

8. A fuel injector retention arrangement as in claim 7, wherein:

said retainer first leg includes a first retainer recess which is concave facing toward said retainer second leg, said first retainer recess accommodating said fuel injector upper housing when said retainer first leg free end and said retainer second leg free end are elastically moved toward each other in order to allow said retainer to be removed from said within said fuel rail socket interior space in a direction along said fuel rail socket axis; and said retainer second leg includes a second retainer recess which is concave facing toward said retainer first leg, said second retainer recess accommodating said fuel injector upper housing when said retainer first leg free end and said retainer second leg free end are elastically moved toward each other in order to allow said retainer to be installed into, and removed from, within said fuel rail socket interior space in a direction along said fuel rail socket axis.

9. A fuel injector retention arrangement as in claim 1, wherein:

said retainer first leg surface is located radially outward from said first retainer recess relative to said fuel rail socket axis; and said retainer second leg surface is located radially outward from said second retainer recess relative to said fuel rail socket axis.

10. A fuel injector retention arrangement as in claim 1, wherein said fuel rail socket retention groove extends to said fuel rail socket exterior surface at said fuel rail socket slot and said retainer first leg and said retainer second leg are located within said fuel rail socket retention groove where said fuel rail socket retention groove meets said fuel rail socket exterior surface at said fuel rail retention groove.

11. A fuel injector retention arrangement as in claim 10, wherein:

said fuel rail socket slot is a first fuel rail socket slot and said fuel injector retention arrangement further comprises a second fuel rail socket slot extending radially from said fuel rail socket interior space to said fuel rail socket exterior surface and also extending axially to said fuel rail socket end surface such that said second fuel rail socket slot is diametrically opposed to said first fuel rail socket slot, wherein said retainer first leg and said retainer second leg each extend through said second fuel rail socket slot; and said fuel rail socket retention groove extends to said fuel rail socket exterior surface at said second fuel rail socket slot and said retainer first leg and said retainer second leg are located within said fuel rail socket retention groove where said fuel rails socket retention groove meets said fuel rail socket exterior surface at said second fuel rail socket slot.

12. A fuel injector retention arrangement as in claim 1, wherein:

said fuel injector retention flange surface faces in a direction toward said fuel rail socket end surface;

said retainer first leg surface and said retainer second leg surface face toward, and mate with, said fuel injector retention flange surface.

13. A fuel injector retention arrangement as in claim 12, wherein:

said fuel rail socket slot is a first fuel rail socket slot and said fuel injector retention arrangement further comprises a second fuel rail socket slot extending radially from said fuel rail socket interior space to said fuel rail socket exterior surface and also extending axially to said fuel rail socket end surface such that said second fuel rail socket slot is diametrically opposed to said first fuel rail socket slot, wherein said retainer first leg and said retainer second leg each extend through said second fuel rail socket slot; and said fuel rail socket retention groove extends to said fuel rail socket exterior surface at said second fuel rail socket slot and said retainer first leg and said retainer second leg are located within said fuel rail socket retention groove where said fuel rails socket retention groove meets said fuel rail socket exterior surface at said second fuel rail socket slot.

14. A fuel injector retention arrangement for retaining a fuel injector to a fuel rail socket of a fuel rail, said fuel injector having a fuel injector upper housing which defines a fuel inlet to said fuel injector, said fuel rail socket having a fuel rail socket body, and said fuel rail having a fuel rail volume which receives pressurized fuel; said fuel injector retention arrangement comprising:

a fuel rail socket interior space defined within said fuel rail socket body such that said fuel rail socket interior space extends into said fuel rail socket body along a fuel rail socket axis from a fuel rail socket end surface, said fuel rail socket interior space being in fluid communication with said fuel rail volume;

a fuel injector retention flange extending radially outward from said fuel injector upper housing such that said fuel injector retention flange is disposed within said fuel rail socket interior space and such that said fuel inlet is in fluid communication with said fuel rail socket interior space;

a fuel rail socket slot extending radially from said fuel rail socket interior space to a fuel rail socket exterior surface and also extending axially to said fuel rail socket end surface;

a fuel rail socket retention groove which extends radially outward from said fuel rail socket interior space; and a retainer which is forked, thereby including 1) a retainer first leg located between said fuel injector retention flange and said fuel rail socket end surface and extending through said fuel rail socket slot and 2) a retainer second leg located between said fuel injector retention flange and said fuel rail socket end surface and extending through said fuel rail socket slot, said retainer first leg and said retainer second leg being connected to each other at one end by a retainer base, said retainer first leg having a first retainer lobe which is convex and which extends part way into said fuel rail socket retention groove and part way into said fuel rail socket interior space, thereby supporting said fuel injector retention flange thereon and retaining said fuel injector to said fuel rail socket and said retainer second leg having a second retainer lobe which is convex and which extends part way into said fuel rail socket retention groove and part way into said fuel rail socket interior space, thereby supporting said fuel injector retention flange thereon and retaining said fuel injector to said fuel rail socket;

wherein said fuel rail socket retention groove extends to said fuel rail socket exterior surface at said fuel rail socket slot and said retainer first leg and said retainer second leg are located within said fuel rail socket retention groove where said fuel rail socket retention groove meets said fuel rail socket exterior surface at said fuel rail retention groove.

15. A fuel injector retention arrangement for retaining a fuel injector to a fuel rail socket of a fuel rail, said fuel injector having a fuel injector upper housing which defines a fuel inlet to said fuel injector, said fuel rail socket having a fuel rail socket body, and said fuel rail having a fuel rail volume which receives pressurized fuel; said fuel injector retention arrangement comprising:

a fuel rail socket interior space defined within said fuel rail socket body such that said fuel rail socket interior space extends into said fuel rail socket body along a fuel rail socket axis from a fuel rail socket end surface, said fuel rail socket interior space being in fluid communication with said fuel rail volume;

a fuel injector retention flange extending radially outward from said fuel injector upper housing such that said fuel injector retention flange is disposed within said fuel rail socket interior space and such that said fuel inlet is in fluid communication with said fuel rail socket interior space;

a first fuel rail socket slot extending radially from said fuel rail socket interior space to a fuel rail socket exterior surface and also extending axially to said fuel rail socket end surface;

a second fuel rail socket slot extending radially from said fuel rail socket interior space to said fuel rail socket exterior surface and also extending axially to said fuel rail socket end surface such that said second fuel rail socket slot is diametrically opposed to said first fuel rail socket slot;

a fuel rail socket retention groove which extends radially outward from said fuel rail socket interior space; and a retainer which is forked, thereby including 1) a retainer first leg located between said fuel injector retention flange and said fuel rail socket end surface and extending through said fuel rail socket slot and 2) a retainer second leg located between said fuel injector retention flange and said fuel rail socket end surface and extending through said first fuel rail socket slot and said second fuel rail socket slot, said retainer first leg and said retainer second leg being separated from each other by a retainer space and being connected to each other at one end by a retainer base, said retainer first leg having a first retainer lobe which is convex and which extends part way into said fuel rail socket retention groove and part way into said fuel rail socket interior space, thereby supporting said fuel injector retention flange thereon and retaining said fuel injector to said fuel rail socket and said retainer second leg having a second retainer lobe which is convex and which extends part way into said fuel rail socket retention groove and part way into said fuel rail socket interior space, thereby supporting said fuel injector retention flange thereon and retaining said fuel injector to said fuel rail socket, wherein said retainer space is located within said first fuel rail socket slot and said second fuel rail socket slot.

* * * * *